US005507354A

United States Patent [19]

Harleman

[11] Patent Number: 5,507,354

[45] Date of Patent: Apr. 16, 1996

[54] POST HOLE DIGGER

[76] Inventor: Ronald E. Harleman, Rte. 1, Box 131B, Appleton City, Mo. 64724

[21] Appl. No.: 346,075

[22] Filed: Nov. 29, 1994

[51] Int. Cl.[6] ..... E21B 7/02; E21C 11/02

[52] U.S. Cl. ..... 175/162; 175/203; 175/170; 173/26; 173/185

[58] Field of Search ..... 175/170, 203, 175/162; 173/185, 26, 28

[56] References Cited

U.S. PATENT DOCUMENTS

| | | | |
|---|---|---|---|
| 2,217,300 | 10/1940 | Templeton | 175/170 |
| 2,581,535 | 1/1952 | Jackson | 175/170 X |
| 2,856,156 | 10/1958 | Young | 175/170 X |
| 2,890,860 | 6/1959 | Smith | 175/170 X |
| 2,969,844 | 1/1961 | Hamrick | 175/170 X |
| 3,291,231 | 12/1966 | Kammer | 175/170 |
| 3,429,386 | 2/1969 | Secrist et al. | 175/170 |
| 3,548,604 | 12/1970 | Campbell | 405/303 |
| 3,638,701 | 2/1972 | Zizak | 175/215 |
| 3,700,045 | 10/1972 | Coontz | 173/26 |
| 4,193,459 | 3/1980 | Engstrom | 173/43 |
| 4,836,294 | 6/1989 | Bencriscutto | 172/22 |
| 4,961,471 | 10/1990 | Ovens | 175/170 |
| 4,979,578 | 12/1990 | Landry | 175/162 |
| 4,986,373 | 1/1991 | Charland et al. | 175/21 |

OTHER PUBLICATIONS

Danuser Machine Company, Inc. "Diggers" brochure, Form No. 2819.

*Primary Examiner*—Stephen J. Novosad
*Attorney, Agent, or Firm*—Chase & Yakimo

[57] ABSTRACT

A post hole digger for attachment to the three-point hitch of a tractor comprises a mainframe having a position control/lock down assembly mounted thereto for raising and lowering the frame and securing the frame to the tractor. A pair of bipartite booms having first and second angled arms are pivotally mounted to the frame. A drill assembly is swingably mounted to a cross beam extending between the second boom arms of each boom. A pair of cylinders extending between the first boom arms and frame pivots the boom arms into and away from a ground drilling position. During the drilling process the bipartite boom configuration compensates for the tendencies of the drill to divert from a true vertical line. The driller transfers the weight of the tractor to the boom arms and the drill connected thereto so as to effectively drill holes in rock-laden soils.

16 Claims, 3 Drawing Sheets

POST HOLE DIGGER

BACKGROUND OF THE INVENTION

This invention relates to a post hole digger and, more particularly, to a digger assembly which effectively centers the auger for drilling in rock-laden soils.

Various devices utilize an auger and frame assembly mounted to the tractor's three-point hitch system. However, such devices do not effectively transfer the weight of the tractor to the auger in order to enable the auger to efficiently drill through rock-laden soils. Moreover, the augers do not always drill a generally true vertical hole as in some cases they are not being directed through a vertical path. Also past digger assemblies have a plurality of linkages between the tractor and auger. Thus, vibration increases which decreases the intensity of forces desired to be transferred to the auger. Accordingly, it is desirable to have a digger which provides sufficient forces for drilling through the rock-laden earth and in a generally vertical line therethrough.

In response thereto I have invented a digger assembly which utilizes a frame securely mounted to the tractor's three-point hitch assembly. The assembly includes a bipartite pivotal boom assembly mounted to a mainframe. The mainframe is adjustable via a position control system. This system also securely locks the mainframe to the tractor which effectively transfers the weight of the tractor to the boom assembly and an auger attached thereto. The use of the bipartite boom configuration urges the auger into a position which drills a generally vertical hole through the underlying earth during pivotal movement of the boom assembly as controlled by a piston/cylinder combination associated with each boom arm.

Accordingly, it is a general object of this invention to provide a post hole digger which is effective in rock-laden soils.

A further object of this invention is to provide a digger, as aforesaid, which is releasably mounted to a user's tractor.

Another object of this invention is to provide a digger, as aforesaid, which utilizes bipartite boom arms so as to drill a generally vertical hole through pivotal movement of the boom assembly.

Still a further object of this invention is to provide a digger, as aforesaid, which provides a position control system for mounting the digger to the tractor at various vertical positions relative to the ground.

A more particular object of this invention is to provide a digger with position control system, as aforesaid, the latter securing the assembly to the tractor to allow for an effective transfer of the weight of the tractor to the auger.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
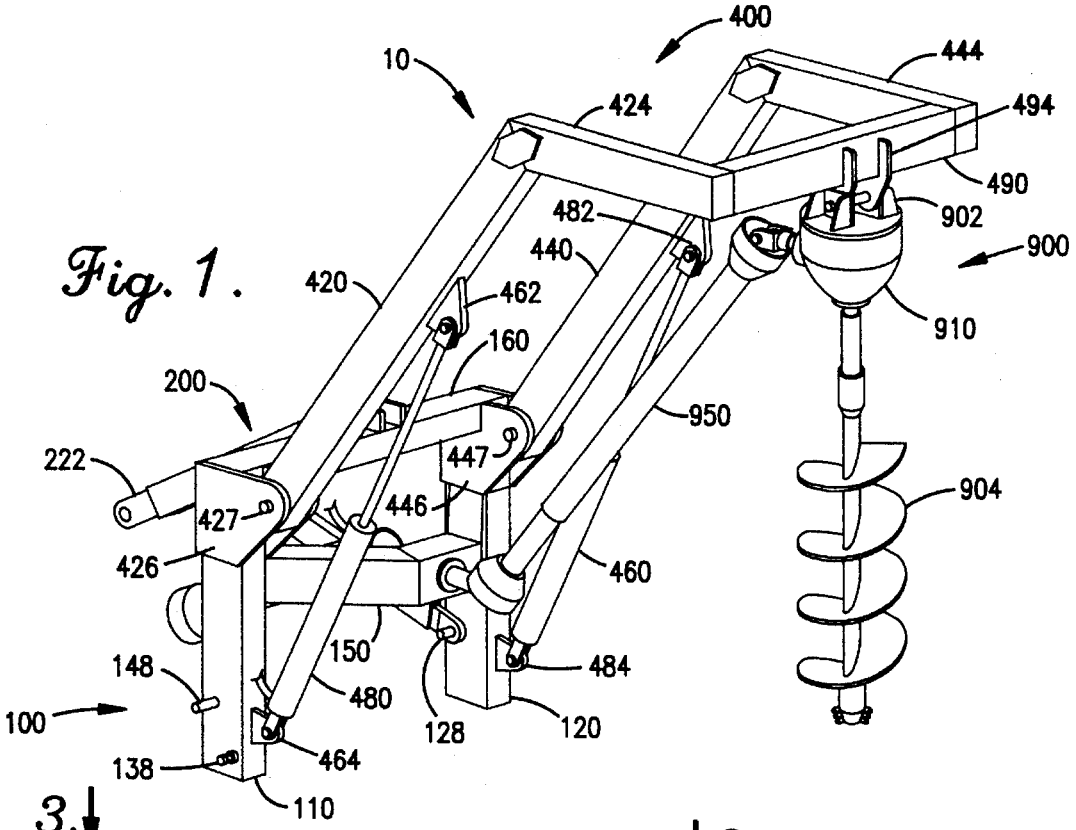
FIG. 1 is a perspective view of a first embodiment of the digger assembly.

Turning more particularly to the drawings, FIG. 1 generally shows the digger 10 as comprising a mainframe assembly 100 with a boom assembly 400 pivotally mounted thereto. An auger assembly 900 is swingably mounted to the front of the boom assembly 400 and is powered by a power take off (PTO) shaft 950 as powered by the tractor's power shaft 1050.

The mainframe assembly 100 generally comprises first 110 and second 120 laterally spaced-apart legs with a yoke 150 extending therebetween. Extending between the top end of each leg 110, 120 is a strut 160. A universal connector 960 joins PTO shafts 950, 940, the latter being driven by the tractor's powered shaft 1050.

A position control/lock down assembly 200 is rearwardly mounted to the frame 100. This assembly 200 generally comprises a bracket 210 centrally attached atop the laterally extending strut 160. Pivotally mounted to the bracket 210 about pin 212 is one end of a central top link 220 with the opposed end 222 thereof being attached to the center connector arm 1020 of the tractor's three-point hitch assembly.

Extending from the central arm 220 are first and second adjustable side links 210, 230. Each link 210, 230 comprises a first housing 212, 232 pivotally mounted to opposed sides of central link 220 with a slidable arm 214, 234 therein. Each slidable arm 214, 234 has a plurality of apertures 216, 236 along its length. A selectable aperture 216, 236 is aligned with the apertures 213, 233 of the respective housings 212, 232 and held in alignment by a pin extending therethrough. The free ends of each slidable arm 214, 234 present an aperture for receiving a pin 128 (FIG. 1) extending from the lower interior surface of each leg 110, 120. Attachment of the frame 100 to the tractor is accomplished by sliding the ends of the side arm connectors 1030, 1040 of the three-point hitch assembly over pins 148 on legs 110, 120 with connection of the end 222 of top link to the center 1020 of the three-point hitch. Once attached vertical adjustment of the frame 100, relative to the ground, is accomplished by either shortening or lengthening the extension of arms 214, 234 relative to their respective housings 212, 232. Such shortening or lengthening will either raise or lower the mounted frame assembly 100 relative to the ground. Thus, the higher positions will provide ground clearance while the lower positions will increase drilling depth. Accordingly, as the three-point hitch assembly is not needed to raise or lower the mainframe 100, the mainframe assembly 100 is securely connected to the tractor. Thus, the tractor weight can be directed through the mainframe and the auger connected thereto.

Pivotally mounted to the top of the frame assembly 100 is a boom assembly 400 comprising a pair of laterally displaced bipartite booms 420, 440. Each boom 420, 440 comprises a first elongated and a second relatively shorter second arms 422, 424 and 442, 444 with an approximately 45° degree angle therebetween. (I have found a five foot length for arms 422, 442 and a two foot length for arms 424, 444 to be effective in use.) The proximal free end of arms 422, 442 are pivotally mounted about pins 427, 447 extending through brackets 426, 446 extending from the top of frame legs 110, 120.

Extending between legs 110, 120 and the boom arms 422, 442 are a pair of double action hydraulic cylinders/piston combinations 460, 480 connected at their respective ends about pins extending through brackets 462, 464 and 482, 484. These hydraulic cylinders are operator controlled by a hydraulic assembly being part of the conventional remote outlets of the tractor proper.

Swingably mounted to a cross strut 490 extending between the front ends of arms 424, 444 is the auger assembly 900. The auger assembly 900 presents brackets 902 swingably mounted about a pin 903 extending through a bracket 494 connected to the cross strut 490. This mounting positions the drill 904 in a generally vertical depending position. Shaft 950 is connected to the gear mechanism 906 so as to rotate drill 904 by power supplied by the tractor PTO 1050. (Hydraulic power can also be utilized.)

Figure 2:
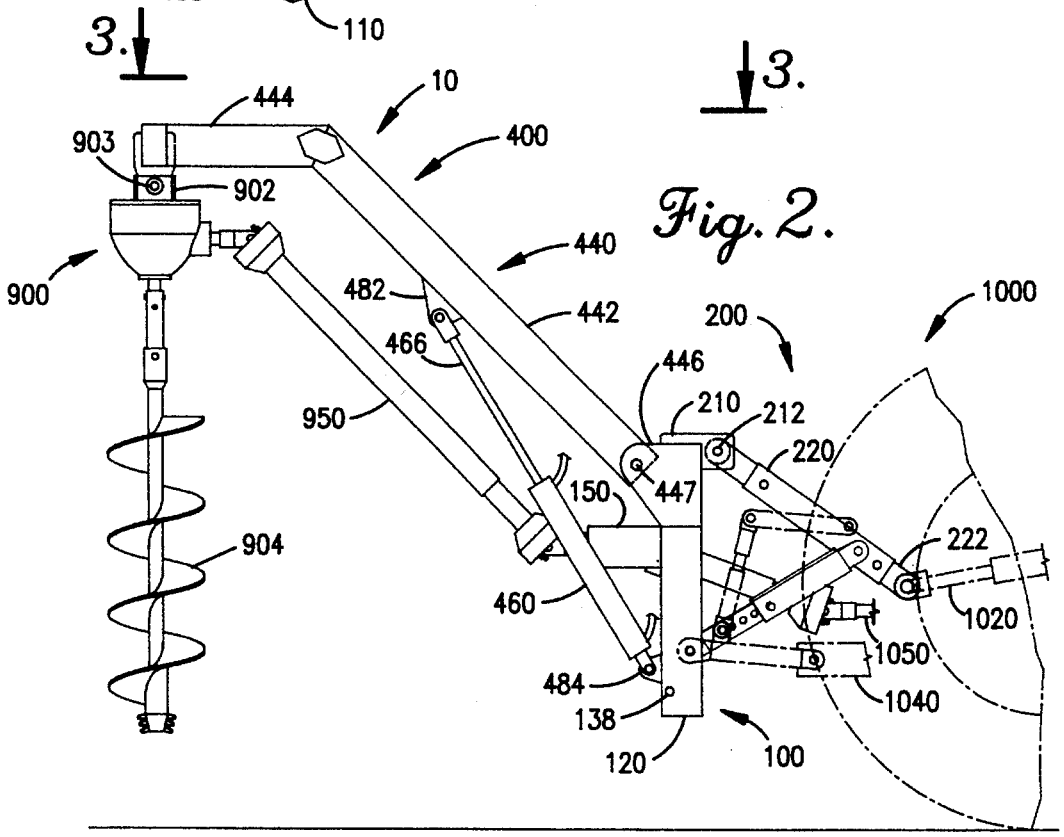
FIG. 2 is an opposed side view of the assembly of FIG. 1 as mounted to the rear of a tractor via the three-point hitch assembly both being fragmentarily shown.
Figure 3:
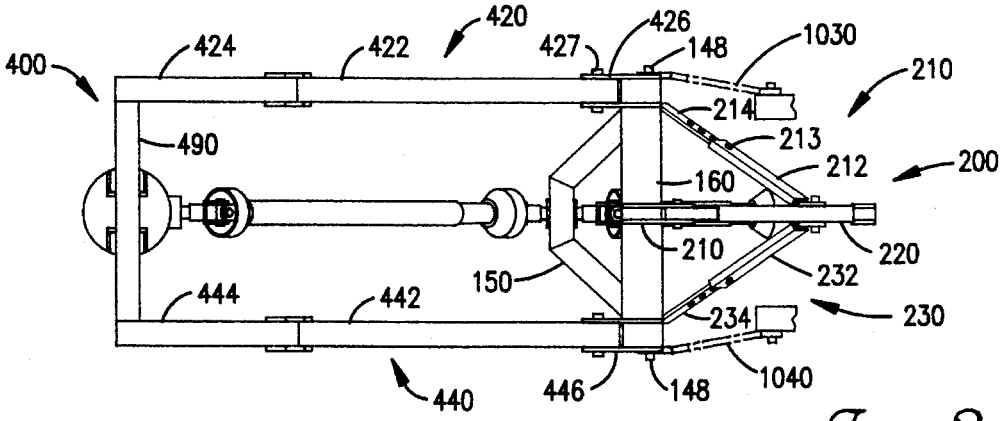
FIG. 3 is a top view of the assembly taken along lines 3—3 in FIG. 2.
Figure 4:
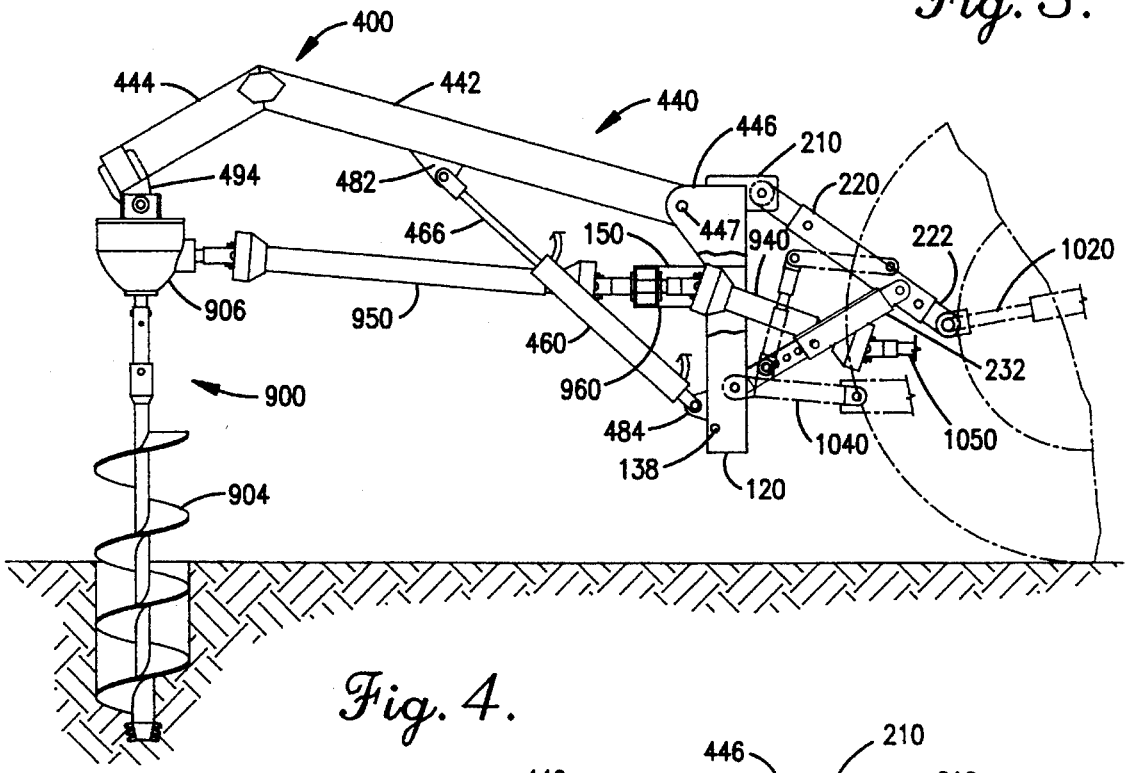
FIG. 4 is a side view of the assembly of FIG. 2 in a drilling position with a portion of the mainframe and intermediate yoke being broken away to show the connections of the power take off assembly.

In use the frame assembly 100 is mounted to the tractor's three-point hitch assembly with the frame then being vertically adjusted by means of the side links 210, 230 as above described. The connection of the side links 210, 230 to the top link 220, with the latter connected to the link 1020 of the three-point assembly, securely joins the frame 100 to the tractor. As the three-point hitch is not needed to raise or lower the frame 100 as in other devices, the secure juncture of the frame 100 with the tractor is maintained. The auger 904 is then positioned over the earth to be drilled as shown in FIG. 2 the short arms 424, 444 being shown as generally parallel thereto. Retraction of the piston rods 466, 486 pivots the boom assembly 400 so as to direct the auger 904 into the underlying soil. It is here noted that the use of the bipartite boom arms 420, 440 compensates for the tendency of the drill to divert from a true vertical line. As the long arms 422, 442 pivot from their FIG. 2 position towards a parallel relationship with the ground, the arms travel through a generally circular path. Thus, the auger 904 tends to divert away from the tractor 904 proper. However, as the short arms 424, 444 approach the ground the auger 904 is urged in an opposed direction. Accordingly, these countervailing diversions combine to vertically position the drill 904 during the drilling process.

It can be appreciated that the retracting of the piston rods 466, 486 of the hydraulic cylinders and not the three-point hitch assembly causes the downward movement of drill 904. As the drill 904 reaches rock or other hard materials the countervailing forces on the drill attempt to elevate the boom arms 420, 440. The hydraulic cylinders 460, 480 between the boom arms and the stabilized frame 100 and the lock down assembly 200 stabilize the frame 100 so that such countervailing forces can be overcome with the weight of the tractor as transferred to the drill 904. Thus, downward travel of drill 904 will continue.

Figure 5:
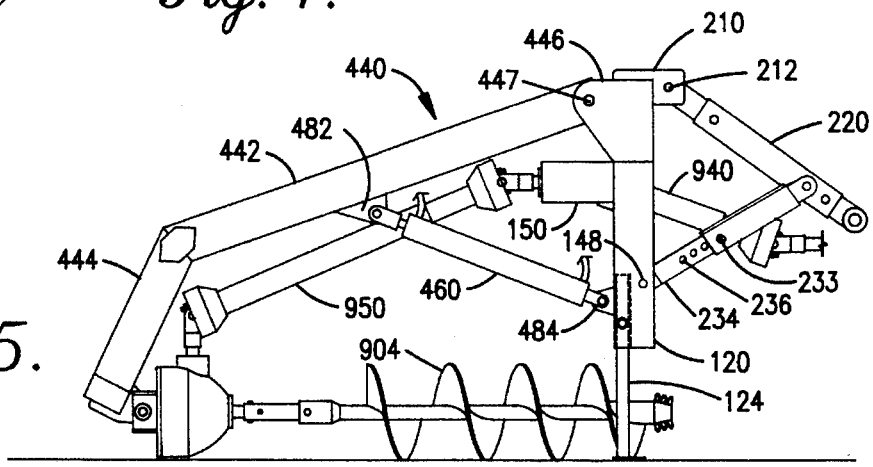
FIG. 5 is a side view of the digger assembly in a storage position as released from the tractor.

FIG. 5 shows the driller 10 is in a storage position. As such storage legs 124 are first extended from the vertical legs 110, 120 upon withdrawal of pinch bolts 138 extending through the legs 110, 120. The extended legs 124 are held in place by the pinch bolts 138 extending through the apertures in legs 110, 120 and against legs 124. The tractor is then backed up to cause the drill assembly 900 to rotate towards a ground parallel position. The boom arms 420, 440 are then lowered with the auger. The three-point hitch of the tractor assembly is then removed and the tractor pulled away.

Figure 6:
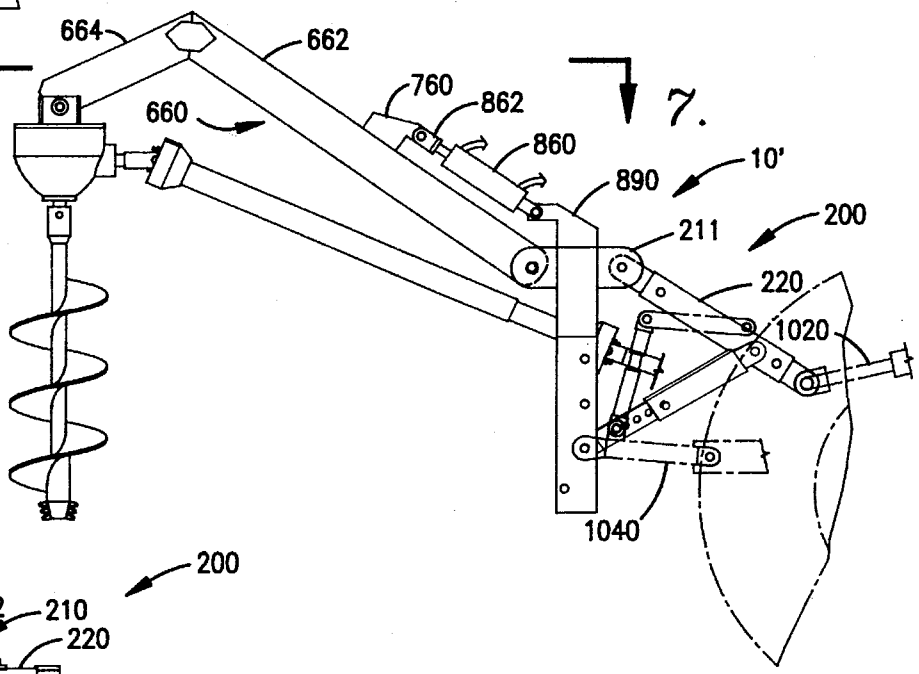
FIG. 6 is a side view showing an alternative embodiment of the digger assembly utilizing one boom arm.
Figure 7:
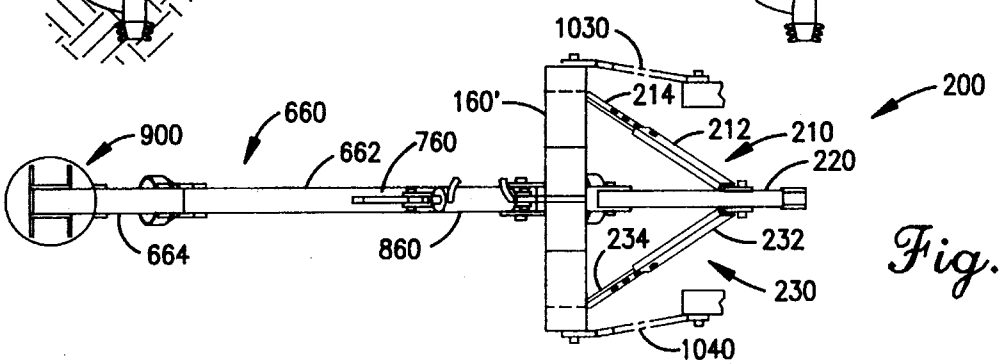
FIG. 7 is a top view of the assembly taken along lines 7—7 in FIG. 6.
Figure 8:
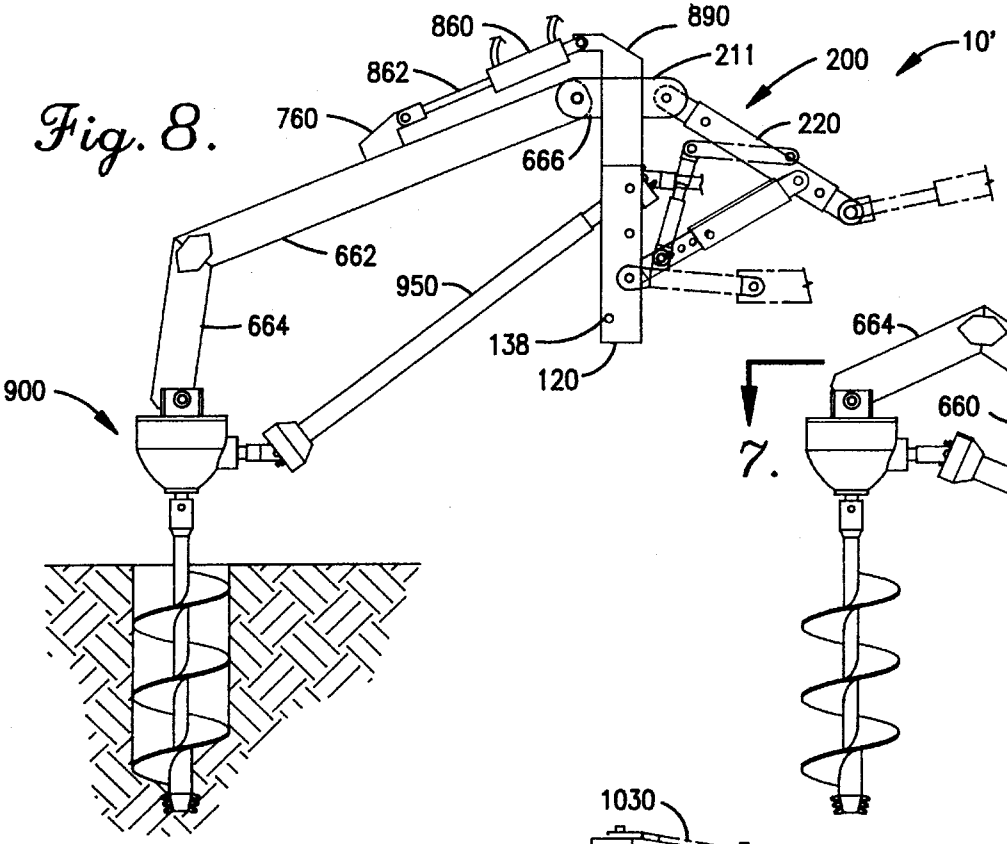
FIG. 8 is a side view of the assembly of FIG. 6 in a drilling position.

FIGS. 6–8 show an alternative embodiment 10' of the driller 10 which utilizes a single bipartite boom 660 having first and second arms 662, 664 at an approximately 60° angle therebetween. The proximal free end of boom arm 662 is pivotally mounted to a bracket 666 extending from the top strut 160' of frame 100'. A bracket 760 is mounted to the boom arm 662 with the piston rod 862 of hydraulic cylinder 860 attached thereto. The cylinder 860 end is attached to a bracket arm 890 upwardly extending from the top strut 160' frame 100'. The end of central link 220 is attached to bracket 211 rearwardly extending from strut 160'. (No yoke 150 extends between legs 110, 120.)

This embodiment 10' is attached to the three-point hitch of the tractor as above described. Such a single boom 660 is designed to be used in soils having lesser density. Thus, upon extension of the piston rod 862 from cylinder 860 the boom 660 downwardly directs the auger 900 to the underlying earth with the arms 662, 665 of the bipartite boom 660 correcting the movements of the auger 904 as above described. Again, the effective connection of the driller 10' to the tractor by the lock down/position control assembly 200 allows for a secure connection of the digger 10' for effective transfer of the tractor's weight to the boom 660 even when utilizing a piston/cylinder combination 860 mounted atop a boom 660.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A tractor mounted drill assembly for attachment to the tractor comprising:

a frame assembly;

means for mounting said frame assembly to the tractor in a user-selectable vertical displacement of said frame from a ground supporting surface;

a boom assembly comprising at least one bipartite boom with a first boom arm having a free proximal end and a second boom arm at an angle relative to said first boom arm having a free distal end, said at least one boom pivotally mounted at a proximal end of said first boom arm to said frame assembly, said second boom arm shorter than said first boom arm and having a starting position generally parallel to a ground surface therebelow;

means for swingably mounting the drill assembly to said distal end of said second arm of said at least one boom; and means extending between said boom and said frame for pivoting said boom assembly and drill assembly attached thereto between ground displaced and ground penetrating positions.

2. The apparatus as claimed in claim 1 wherein said frame assembly mounting means comprises:

a central arm rearwardly extending from said frame with one end attached to said frame and the other end to the tractor;

at least one side arm assembly having one end attached to said central arm and said other end attached to said frame, each side arm assembly comprising:

a housing including said end attached to said central arm;

an aperture in said housing;

an arm slidable within said housing and having said other end attached to said frame;

a plurality of apertures along said slidable arm;

a pin for extension through said aperture in said housing and an aligned aperture in said slidable arm, whereupon extension and retraction of said slidable arm relative to said housing raises or lowers said attached frame relative to the underlying ground.

3. The apparatus as claimed in claim 2 wherein said other end of each side arm is attached to a bottom of said frame.

4. The apparatus as claimed in claim 2 comprising first and second side arm assemblies, each one end of each side arm assembly being attached on opposed sides of said central arm.

5. The apparatus as claimed in claim 4 wherein said other end of said central arm is attached to a three-point hitch of the tractor.

6. The apparatus as claimed in claim 1 wherein said frame comprises:

first and second laterally spaced-apart legs;

a third leg slidable in and out of each of said first and second legs;

means for holding each third leg in a selected position relative to said first and second legs.

7. The apparatus as claimed in claim 6 wherein said first and second legs of said frame is connected to a three-point hitch of the tractor.

8. The apparatus as claimed in claim 1 wherein said angular relationship between said first and second boom arms is approximately 45°.

9. The apparatus as claimed in claim 1 wherein said boom assembly pivot means comprises a piston/cylinder combination with one end of said piston attached underneath said boom and one end of said cylinder attached to said frame whereupon extension and retraction of said piston relative to said cylinder raises and lowers said boom.

10. A tractor mounted drill assembly for attachment to the tractor comprising:

a frame assembly;

means for mounting said frame assembly to the tractor in a user-selectable vertical displacement of said frame from a ground supporting surface;

a boom assembly comprising first and second bipartite booms each having a first boom arm having a free proximal end and a second boom arm at an angle relative to said first boom arm having a free distal end, each boom pivotally mounted at a proximal end of said first boom arm to said frame assembly in a laterally spaced-apart relationship, said second boom arm being shorter than said first boom arm and having a starting position generally parallel to a ground surface therebelow;

a strut extending between said booms at said distal ends of said second boom arms;

means for swingably mounting the drill assembly to said strut; and means extending between said boom assembly and said frame for pivoting said boom assembly and drill assembly attached thereto between ground displaced and ground penetrating positions.

11. The apparatus as claimed in claim 10 wherein said frame assembly mounting means comprises:

a central arm rearwardly extending from said frame with one end attached to said frame and the other end to the tractor;

first and second side arm assemblies having one end attached to opposed sides of said central arm and said other end attached to said frame, each side arm assembly comprising:

a housing including said end attached to said central arm;

an aperture in said housing;

an arm slidable within said housing and having said other end attached to said frame;

a plurality of apertures along said slidable arm;

a pin for extension through said aperture in said housing and an aligned aperture in said slidable arm, whereupon extension and retraction of said slidable arm relative to said housing raises or lowers said attached frame relative to the underlying ground.

12. The apparatus as claimed in claim 11 wherein said other end of said central arm is attached to a three-point hitch of the tractor.

13. The apparatus as claimed in claim 11 wherein said frame comprises:

first and second laterally spaced-apart legs;

a cross strut extending between said legs, said one end of said central arm connected to said cross strut;

means on each leg for joining said other end of each slidable arm to said frame.

14. The apparatus as claimed in claim 13 wherein each leg of said frame is further connected to a three-point hitch of the tractor.

15. The apparatus as claimed in claim 10 wherein said boom assembly pivot means comprises a piston/cylinder combination with one end of said piston attached underneath each boom and one end of said cylinder attached to said frame whereupon extension and retraction of said piston relative to said cylinder raises and lowers said booms.

16. For use with a tractor having a three-point hitch, a mainframe assembly for a tool assembly and attachment to said three-point hitch, said mainframe assembly comprising:

first and second laterally spaced-apart legs, each leg attached to the three-point hitch;

a strut extending between said legs;

a central arm having one end connected to said strut and the other end to the three-point hitch;

at least one side arm assembly having one end attached to said central arm and said other end attached to said mainframe, each side arm assembly comprising:

a housing including said end attached to said central arm;

an aperture in said housing;

an arm slidable within said housing and having said other end attached to one of said legs of said mainframe;

a plurality of apertures along said slidable arm;

a pin for extension through said aperture in said housing and an aligned aperture in said slidable arm, whereupon extension and retraction of said slidable arm relative to said housing raises or lowers the attached mainframe and the tool assembly attached thereto relative to the underlying ground.

* * * * *